US006194825B1

(12) United States Patent
Kim et al.

(10) Patent No.: US 6,194,825 B1
(45) Date of Patent: Feb. 27, 2001

(54) LASER CATHODE RAY TUBE (LASER-CRT) AND METHOD OF MANUFACTURING THE SAME

(75) Inventors: Moon-gueon Kim; Jong-sick Choi, both of Suwon (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/168,088

(22) Filed: Oct. 8, 1998

(30) Foreign Application Priority Data

Oct. 13, 1997 (KR) ..... 97-52357

(51) Int. Cl.[7] ..... H01J 29/10
(52) U.S. Cl. ..... 313/474; 313/463; 445/45
(58) Field of Search ..... 313/463, 474, 313/477 R, 366, 378, 383, 476, 461; 445/45, 24

(56) References Cited

U.S. PATENT DOCUMENTS 4,650,108 * 3/1987 Gallagher ..... 228/124
5,374,870 12/1994 Akhekyan et al. ..... 313/474

FOREIGN PATENT DOCUMENTS 2482366 11/1981 (FR) .

* cited by examiner

*Primary Examiner*—Vip Patel
*Assistant Examiner*—Joseph Williams
(74) *Attorney, Agent, or Firm*—Lowe Hauptman Gilman & Berner, LLP

(57) ABSTRACT

A laser cathode ray tube (laser-CRT) is provided. The laser-CRT includes a connection ring connected to an end portion of a glass bulb where an electron gun is installed, a disk having a single-crystal for generating laser beams when electron beams emitted from the electron gun are input, a support ring connected to the disk and the connection ring, and a junction layer interposed between the support ring and the disk, having at least two metal thin films which have been pressurized and heated, to connect the support ring and the disk to each other.

4 Claims, 3 Drawing Sheets

LASER CATHODE RAY TUBE (LASER-CRT) AND METHOD OF MANUFACTURING THE SAME

BACKGROUND OF THE INVENTION

1. Field of the Invention

The present invention relates to a laser cathode ray tube (laser-CRT) and a method of manufacturing the same, and more particularly, to a laser-CRT in which the structure connecting a disk to a metal ring is improved to maintain a vacuum during operation of the laser-CRT at a low temperature.

2. Description of the Related Art

Referring to FIG. 1, a conventional laser-CRT includes a glass bulb 12 having an electron gun 11 emitting electron beams inserted therein, a connection ring 13 connected to an end of the glass bulb 12, a target portion 14 on which electron beams emitted from the electron gun 11 collide to generate a laser beam to form an image, and a support ring 15 in which the target portion 14 is installed, connected to the connection ring 13. Here, the target portion 14 includes a single-crystal 16 for generating a laser beam when the electron beam is input, a resonator 18 composed of mirrors 17*a* and 17*b* formed on both sides of the single-crystal 16, and a disk 19 connected to one side of the resonator 18.

The inside of the laser-CRT is maintained in a vacuum, and when the electron beams emitted from the electron gun 11 are accelerated toward the target portion 14 to collide against the single-crystal 16 of the resonator 18, the laser beams are generated, to thereby form an image. The temperature of the single-crystal 16 must be maintained at 80–200K to generate stable laser beams, so that the disk 19 formed of sapphire having excellent thermal emission is connected to one side of the resonator 18. Also, a refrigerant such as liquid nitrogen is supplied to the disk 19 to maintain the resonator 18 at a relatively low temperature.

The room temperature of the laser-CRT becomes a low temperature during driving, so that junction portions of components are deformed due to a difference in the respective thermal expansion coefficients and thus the vacuum state of the laser-CRT may be compromised, which occurs more severely at the junction portion between the disk 19 of the target portion 14 and the support ring 15. In detail, referring to FIG. 2, the junction between the disk 19 of a nonmetal and the support ring 15, is realized by a metalizing method in which a metal layer 21 containing Mo or Mn and a Cu-layer 22 are interposed therebetween. That is, in the above junction process, a paste having Mo and Mn as a main material is coated on a surface of the disk 19 and then the surface is dried to thereby form a metal layer 21. Subsequently, when the metal layer 21 is heat-treated at a high temperature, a glass component of the disk 19 reacts with Mn of the metal layer 21 to realize a junction between the metal layer 21 and the disk 19. Also, a Cu-layer 22 is formed between the metal layer 21 and the support ring 15 using a Cu welding material, to thereby connect the disk 19 to the support ring 15.

However, when the conventional laser-CRT having the above junction structure is driven at 80~200K for an extended period of time, the metal layer 21 and the Cu-layer 22 tend to be brittle, so that cracks or deformations occur at the junction portion between the support ring 15 and the disk 19, to thereby damage the vacuum state of the laser-CRT.

When an impurity flows into the laser-CRT due to the lack of integrity in the vacuum state, a proceeding path of electron beams is distorted, so that the electron beams cannot accurately land, to thereby deteriorate the screen quality. Also, the durability of the laser CRT is deteriorated due to weakening of the junction portion, to thereby reduce the life of the device.

SUMMARY OF THE INVENTION

To solve the above problems, it is an objective of the present invention to provide a laser cathode ray tube and a manufacturing method thereof in which a disk and a support ring are connected by an alloy layer having excellent intensity, to thereby maintain the vacuum state of a junction portion between the disk and the support ring even when driven at a low temperature.

Accordingly, to achieve the above objective, a cathode ray tube according to the present invention comprises:

- a connection ring connected to an end portion of a glass bulb where an electron gun is installed;
- a disk having a single-crystal for generating laser beams when electron beams emitted from the electron gun are input;
- a support ring connected to the disk and the connection ring; and
- a junction layer interposed between the support ring and the disk, having at least two metal thin films which have been pressurized and heated, to connect the support ring and the disk to each other.

The metal thin films includes a Ti thin film and a Ni thin film.

According to another aspect of the present invention, there is provided a method of manufacturing a laser cathode ray tube comprising the steps of:

- interposing at least two metal thin films between a support ring and a disk;
- pressurizing the metal thin films; and
- connecting the support ring and the disk to each other by heating the metal thin films.

Here, the metal thin films are heated in a vacuum state or in an atmosphere of an inert gas.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 1:
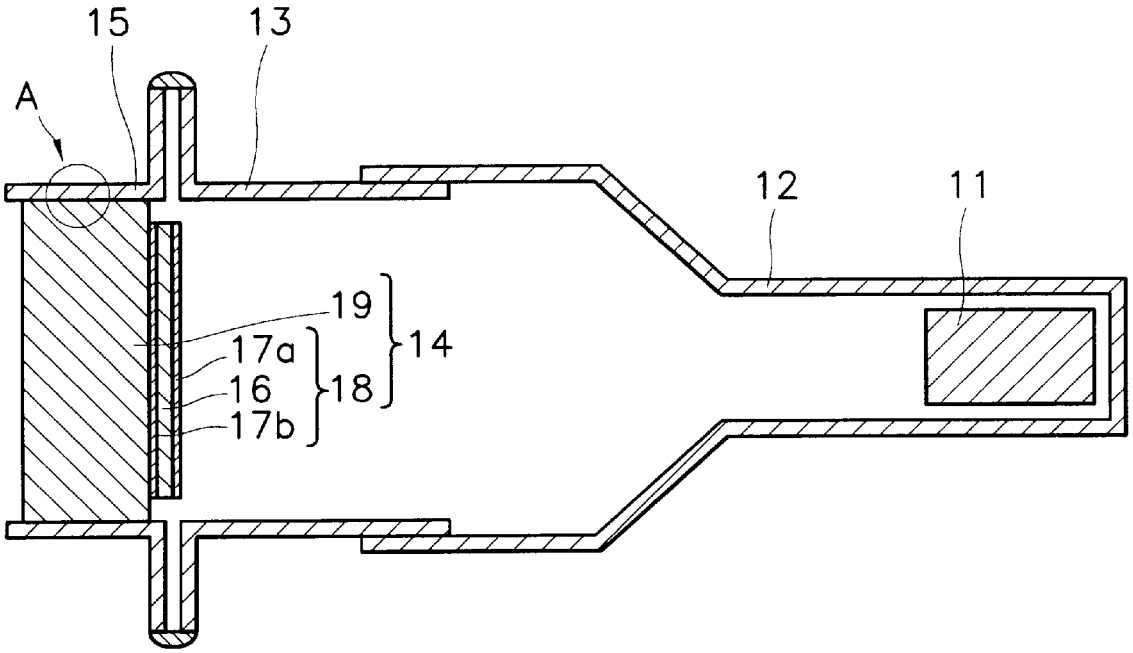
FIG. 1 (PRIOR ART)
FIG. 1 is a sectional view showing a conventional laser cathode ray tube.
Figure 2:
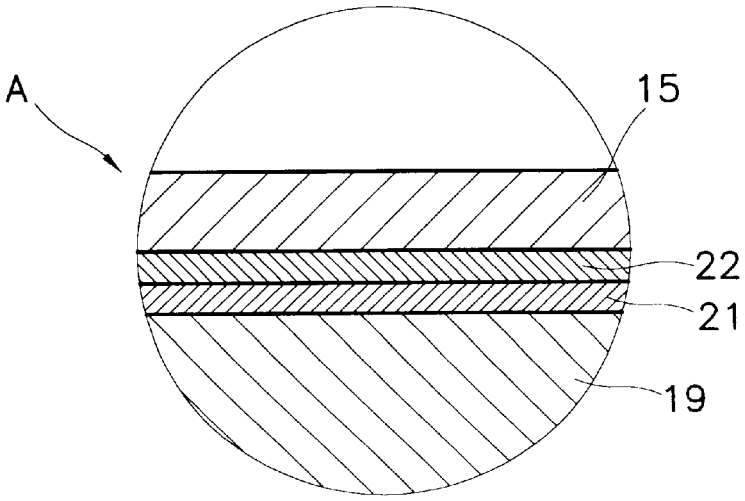
FIG. 2 (PRIOR ART)
FIG. 2 is an enlarged sectional view of portion A of FIG. 1.
Figure 3:
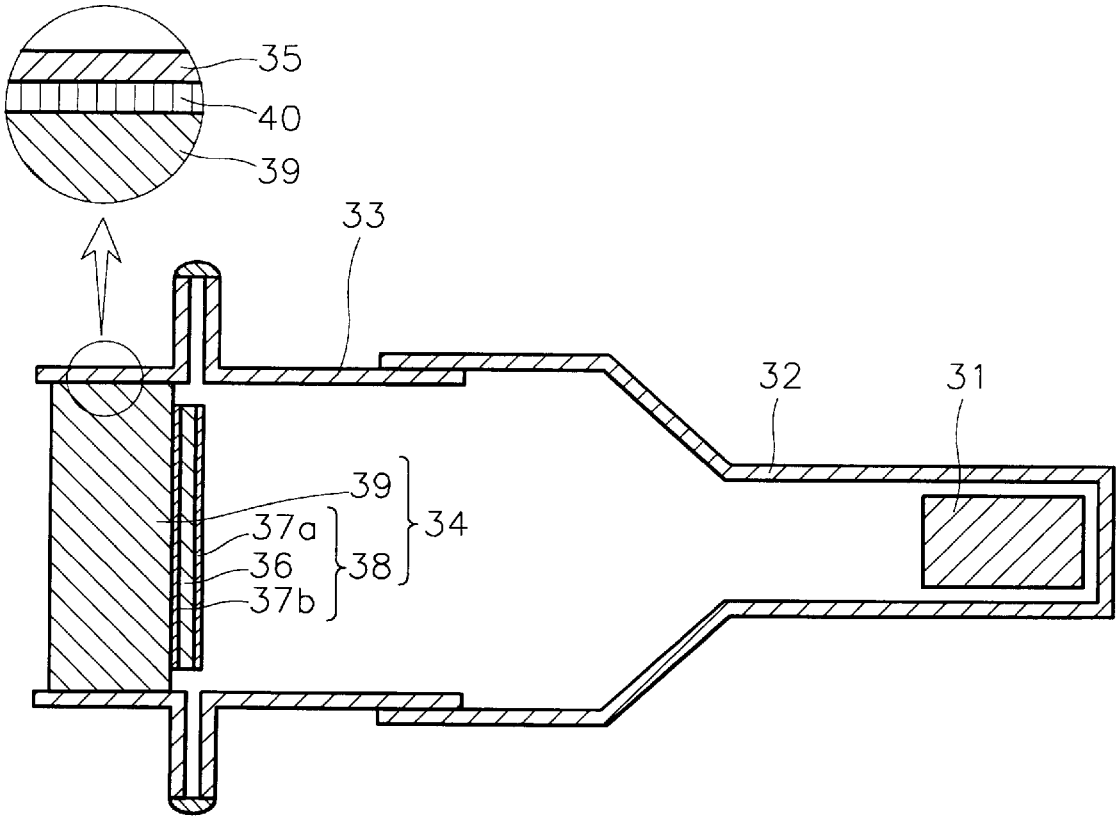
FIG. 3 is a sectional view of a laser cathode ray tube according to the present invention.

Referring to FIG. 3, a laser cathode ray tube of the present invention includes a glass bulb 32 within which an electron gun 31 for emitting electron beams is sealed, a connection ring 33 connected to an end of the glass bulb 32, a single-crystal 36 for generating laser beams when the electron beams are input, a target portion 34 composed of resonator 38 having mirrors 37*a* and 37*b* formed on both sides of the single-crystal 36 and a disk 39 connected to one side of the connection ring 33, and a support ring 35 in which the target portion 34 is installed, connected to the connection ring 33. Here, preferably, the support ring 39 is formed of sapphire having excellent heat emission.

According to characteristics of the present invention, the support ring 35 is connected to the disk 39 by a junction layer 40 formed by pressurizing and heating at least two metal thin films. The junction layer 40, for example, is formed by pressurizing and heating Ti and Ni thin films of a predetermined thickness. Preferably, the support ring 35 is formed of cover containing 29 wt % Ni, 17 wt % Co and Fe for the balance.

A method of manufacturing a laser cathode ray tube having the above structure will be described with reference to FIGS. 4A through 4C. The same reference numerals refer to the same elements.

Figure 4A:
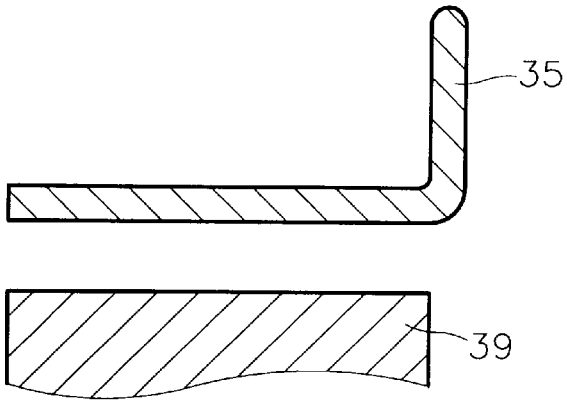
FIGS. 4A through 4C are views illustrating a method of manufacturing a laser cathode ray tube according to the present invention.

The surface of the disk 39 is cleaned by trichloro-ethylene to remove foreign material attached to the surface of the disk 39, and then the disk 39 is spaced apart from the support ring 35 a predetermined distance as shown in FIG. 4A.

Figure 4B:
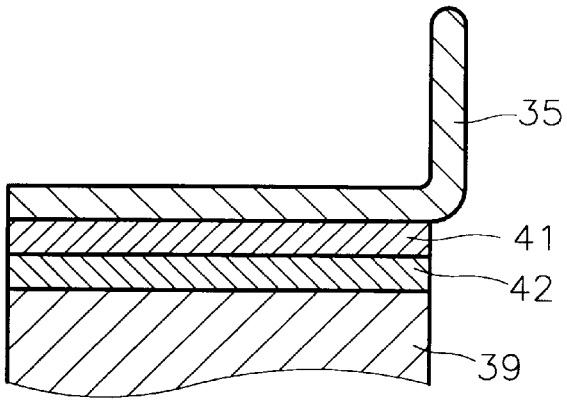
Figure 4C:
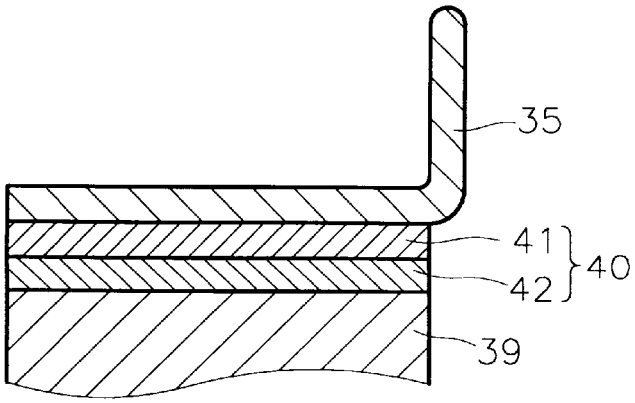

Subsequently, as shown in FIG. 4B, first and second metal thin films 41 and 42 are disposed between the support ring 35 and the disk 39, and then the metal thin films are pressurized. Preferably, the first and second metal thin films 41 and 42 are a Ti thin film and a Ni thin film. At this time, preferably, the Ti thin film and the Ni thin film have a thickness of 0.01 through 0.5 mm, and a purity of approximately 95% or higher. Also, when the purity of the sapphire disk 39 is approximately 99.5% or higher, a glass component may be added to the first and second metal thin films 41 and 42 to improve adhesion to the disk 39.

Then, the first and second metal thin films 41 and 42 between the support ring 35 and the disk 39 which have been pressurized are heated. Preferably, the heating process is performed at approximately 1000° C. or higher and in a vacuum state or in an inert gas atmosphere. Thus, the first and second metal thin films 41 and 42 are connected to each other by being pressurized and heated, to thereby form a junction layer 40, for instance, of Ti—Ni thin films between the support ring 35 and the disk 39. The support ring 35 and the disk are connected to each other due to formation of the junction layer 40.

As described above, the junction layer 40 by the Ti—Ni thin films formed between the support ring 35 and the disk 39 have excellent intensity, particularly excellent mechanical characteristics even at a low temperature, to thereby increase the durability.

Also, according to the method of manufacturing a laser cathode ray tube of the present invention, the support ring and the disk having the Ti—Ni thin films interposed therebetween are pressurized and heated to be connected to each other, to thereby simplify the manufacturing process.

What is claimed is:

1. A laser cathode ray tube (laser-CRT) comprising:

a connection ring connected to an end portion of a glass bulb where an electron gun is installed;

a disk having a single-crystal for generating laser beams when electron beams emitted from the electron gun are input;

a support ring connected to the disk and the connection ring; and a junction layer interposed between the support ring and the disk, having at least two metal thin films which have been pressurized and heated, to connect the support ring and the disk to each other, wherein the metal thin films include a Ti thin film and a Ni thin film.

2. The laser-CRT of claim 1, wherein the support ring is cover consisting of 29 wt % Ni, 17 wt % Co and Fe for the balance.

3. A method of manufacturing a laser-CRT comprising the steps of:

interposing at least two metal thin films between a support ring and a disk;

pressurizing the metal thin films; and connecting the support ring and the disk to each other by heating the metal thin films, wherein the metal thin films are Ti and Ni thin films.

4. The manufacturing method of claim 3, wherein the metal thin films are heated in a vacuum state or in an atmosphere of an inert gas.

* * * * *